US006490766B1

(12) United States Patent
Tiemann

(10) Patent No.: US 6,490,766 B1
(45) Date of Patent: Dec. 10, 2002

(54) COUPLING DEVICE INCLUDING AUTOMATIC LATCHING LOCK

(75) Inventor: James P. Tiemann, Huntington, NY (US)

(73) Assignee: Peck & Hale LLC, West Sayville, NY (US)

( * ) Notice: Subject to any disclaimer, the term of this patent is extended or adjusted under 35 U.S.C. 154(b) by 0 days.

(21) Appl. No.: 09/669,200

(22) Filed: Sep. 25, 2000

(51) Int. Cl.[7] ..... B60B 7/13
(52) U.S. Cl. ..... 24/287; 410/83
(58) Field of Search ..... 24/287, 589, 590, 24/332; 411/347, 552; 206/159; 220/1.5, 23.4, 23.6; 403/348, 350; 410/82, 89, 90, 91

(56) References Cited

U.S. PATENT DOCUMENTS

| | | | | |
|---|---|---|---|---|
| 3,294,420 | A | | 12/1966 | Martin |
| 3,365,229 | A | | 1/1968 | Hitch et al. |
| 3,387,571 | A | | 6/1968 | Matushek et al. |
| 3,399,921 | A | | 9/1968 | Trost et al. |
| 3,578,374 | A | | 5/1971 | Glassmeyer |
| 3,599,824 | A | | 8/1971 | Pneuman |
| 3,683,463 | A | | 8/1972 | Siefer et al. |
| 3,752,511 | A | * | 8/1973 | Racy ..... 24/287 |
| 3,753,272 | A | | 8/1973 | Laidley |
| 3,820,474 | A | | 6/1974 | Backteman et al. |
| 3,860,209 | A | | 1/1975 | Strecker |
| 3,972,439 | A | | 8/1976 | DiMartino |
| 3,973,684 | A | | 8/1976 | Di Martino |
| 4,026,596 | A | | 5/1977 | Carr |
| 4,277,212 | A | | 7/1981 | Rosaia |
| 4,382,734 | A | | 5/1983 | Synowiec et al. |
| 4,400,856 | A | | 8/1983 | Tseng |
| 4,564,984 | A | | 1/1986 | Takaguchi |
| 4,591,307 | A | | 5/1986 | Clive-Smith |
| 4,626,155 | A | | 12/1986 | Hlinsky et al. |
| 4,732,505 | A | | 3/1988 | Gloystein |
| 5,062,752 | A | | 11/1991 | Takaguchi |
| 5,155,960 | A | | 10/1992 | Shaanan |
| 5,160,224 | A | * | 11/1992 | Schwiebert ..... 410/82 |
| 5,454,673 | A | | 10/1995 | DiMartino |
| 5,632,586 | A | | 5/1997 | Nyholm |

* cited by examiner

*Primary Examiner*—Robert J. Sandy
(74) *Attorney, Agent, or Firm*—Hoffmann & Baron, LLP

(57) ABSTRACT

A coupling device for coupling a corner casting of a first freight container to a corner casting of a second freight container including a fully automatic latching lock providing consistent and repeatable release force characteristics. The coupling device preferably includes a positive stop which resists rolling of stacked containers at onset.

22 Claims, 19 Drawing Sheets

10′

COUPLING DEVICE INCLUDING AUTOMATIC LATCHING LOCK

BACKGROUND OF THE INVENTION

The present invention relates to a container coupling device and, more particularly, to a container coupling device including a fully automatic latching lock providing consistent and repeatable release force characteristics.

As will be recognized by those skilled in the art, freight containers are commonly used for transporting cargo by ship and/or rail. These freight containers are generally rectangular and are dimensioned within standardized ranges used throughout the shipping industry. The containers generally include rigid corner castings of standardized size which allow the containers to be vertically and/or horizontally stacked, and thereafter locked to one another. More particularly, the corner castings include elongated or circular openings dimensioned and configured to accept locking devices, e.g., manually operated coupling devices, which allow adjacent corner castings of adjacent containers to be positively locked to one another.

Manually operated coupling devices are well known in the art. Certain known manually operated devices are disclosed in U.S. Pat. Nos. 4,212,251, 4,082,052, and 3,894,493. As will be appreciated by those skilled in the art, these coupling devices are operable between a first position wherein the device is oriented to allow coupling of adjacent corner castings, and a second position wherein the device is oriented to positively lock the adjacent corner castings to one another. In many such devices, the device includes a manually operated lever which is used to move the locking element of the coupling device between a first unlocked position and a second locked position.

In certain applications, it is not convenient and/or desirable to use manually operated coupling devices. For example, when transporting freight containers by rail, the industry often utilizes coupling devices having at least one fully automatic latching lock. Typically, the coupling devices are secured to the corner castings on the underside of a container prior to the container being moved onto the rail car. The coupling devices are oriented such that the automatic latching lock of each device is outwardly directed and thus ready to be coupled to a previously-loaded container. The automatic latching lock thus allows the container to be stacked and secured to an underlying container simply by landing the upper container onto the lower container. Similarly, the automatic latching lock allows the upper container to be uncoupled from the lower container simply through lifting of the upper container.

One common drawback associated with prior art coupling devices having automatic latching locks is repeatability of release loading. More specifically, the vertical force necessary to actuate the automatic latching lock and thus release the upper freight container from the lower freight container must be within an accepted range, and should be repeatable over time and with respect to various containers. As will be appreciated by those skilled in the art, coupling devices themselves are subjected to severe wear through handling and/or exposure to environmental factors. Corner castings of freight containers may also experience wear and/or damage. Together, these factors have made it difficult in the past to provide automatic latching locks, particularly for use in the rail industry, which consistently provide adequate securing forces.

Another potential concern when utilizing coupling devices having automatic latching locks on stacked containers concerns toppling loads, i.e., moments which cause the container to tend to topple from its stacked relationship commonly referred to as "rolling moments." This can be caused by the rolling action of a ship, through the application of wind forces, or by the derailment of a rail car. Under such conditions, the rolling moment experienced by the stacked cargo container could exceed the normal release force of the automatic latching lock of the coupling device thus allowing the stacked container to decouple from the underlying container and/or structure.

There is therefore a need in the art for a coupling device including at least one automatic latching lock which allows stacking of and securement of cargo containers without manual intervention. The coupling device preferably exhibits consistent and repeatable release force characteristics. Finally, the coupling device preferably resists rolling moments at onset, while still utilizing a fully automatic latching lock.

SUMMARY OF THE INVENTION

The present invention, which addresses the needs of the prior art, relates to a coupling device for cooperation with a corner casting of a freight container. The corner casting includes an interior latch-engaging surface. The coupling device includes a body having a base with first and second surfaces. The coupling device further includes an automatic latching lock extending from the first surface of the base and being sized and located for securement to the corner casting of the freight container. The automatic latching lock includes a first support shoulder and a latch assembly. The latch assembly is movably coupled to the support shoulder to allow coupling to and decoupling from the corner casting and is biased to an engagement position. The latch assembly includes a latch having a spring-receiving cavity. Finally, the coupling device includes a spring positioned within the cavity having first and second ends. The first end is supported by the latch, while the second end is surrounded by the cavity and positionally fixed with respect to the base.

The present invention further relates to a coupling device for cooperation with a corner casting of a freight container. The coupling device includes a body having a base with first and second surfaces. The coupling device further includes an automatic latching lock extending from the first surface of the base and being sized and located for securement to the corner casting of the freight container. The automatic latching lock includes a first support shoulder and a latch assembly. The latch assembly is movably coupled to the support shoulder to allow coupling to and decoupling from the corner casting and is biased to an engagement position. The latch assembly is movable in a first direction to allow coupling of the automatic latching lock to the corner casting and is movable in a second direction to allow decoupling of the automatic latching lock from the corner casting, the first direction being different from the second direction.

The present invention further relates to a coupling device for cooperation with a corner casting of a freight container. The coupling device includes a body having a base with first and second surfaces. The coupling device further includes an automatic latching lock extending from the first surface of the base and being sized and located for securement to the corner casting of the freight container. The automatic latching lock includes a latch assembly. The latch assembly is movably coupled to the base to allow coupling to and decoupling from the corner casting and is biased to an engagement position. The latch assembly includes a latch having a tail. The tail includes an upper contact surface located substantially flush with the first surface of the base when the latch is in the engagement position whereby the corner casting presses against both the first surface of the base and the contact surface of the tail when the automatic latching lock is coupled to the corner casting thus urging the latch to the engagement position.

The present invention further relates to a coupling device for coupling a corner casting of a first freight container to a corner casting of a second freight container. The coupling device includes a body having a base. The base has a first surface and a second surface. The coupling device further includes an automatic latching lock for coupling with the corner casting of the first freight container. The automatic latching lock is provided on the first surface of the base. The coupling device further includes a manual twisting lock for coupling with the corner casting of the second freight container. The manual twisting lock is provided on the second surface of the base. The manual twisting lock includes a neck extending from and connected at one end to the second surface of the base. The manual twisting lock further includes a locking element connected to the other end of the neck. The neck includes a pair of opposing protrusions. The manual twisting lock further includes a pair of opposing collar elements each having an interior wall surface. The collar elements surround the neck and are arranged as to allow relative expansion therebetween via interaction between the protrusions and the interior wall surfaces of the collar elements. The interior wall surfaces of the collar elements further include as least one pair of opposing detents sized to receive the protrusions for releasably fixing the collar elements at a predetermined rotational orientation.

The present invention further relates to a coupling device for cooperation with a corner casting of a freight container. The corner casting includes an interior latch-engaging surface. The coupling device includes a body having a base with first and second surfaces. The coupling device further includes an automatic latching lock extending from the first surface of the base and being sized and located for securement to the corner casting of the freight container. The automatic latching lock includes a first support shoulder and a latch assembly. The latch assembly is movably coupled to the support shoulder to allow coupling to and decoupling from the corner casting. Finally, the latch assembly includes a wheel rotatable with respect to the first support shoulder.

Finally, the present invention relates to a method of stacking a first freight container onto a second freight container. The method includes the step of providing a first rectangular freight container having a length and a width and an upper surface. The first freight container has first, second, third and fourth corner castings located along the upper surface. The first and second corner castings are positioned at one end of the freight container along the width. The third and fourth corner castings are positioned at the other end of the freight container along the width. The method includes the further step of providing a second rectangular freight container having a length and a width and a lower surface. The second freight container has first, second, third and fourth corner castings located along the lower surface. The first and second corner castings are positioned at one end of the freight container along the width. The third and fourth corner castings are positioned at the other end of the freight container along the width. The method includes the further step of providing first, second, third and fourth coupling devices. Each of the coupling devices includes a body having a base with first and second surfaces. Each of the coupling devices further includes an automatic latching lock associated with the first surface. The automatic latching lock includes a landing cone having a positive stop. The landing cone defines a roll-limiting direction. Each of the coupling devices further includes a manual twisting lock associated with the second surface. The method includes the further step of securing the manual twisting locks of the first and second coupling devices to the first and second corner castings of the second container such that each of the landing cones is oriented in a first direction. The method includes the further step of securing the manual twisting locks of the third and fourth coupling devices to the third and fourth corner castings of the second container such that each of the landing cones is oriented in a second direction, the first and second directions being oriented 180° apart from one another. Finally, the method includes the step of landing the second freight container on the first freight container such that the automatic latching locks of the first, second, third and fourth coupling devices engage the first, second, third and fourth corner castings of the first freight container, respectively, whereby the first and second coupling devices limit rolling of the second freight container in a first direction and the third and fourth coupling devices limit rolling of the second freight container in a second direction.

As a result, the present invention provides a coupling device including at least one automatic latching lock which allows stacking of and securement of cargo containers without manual intervention. The automatic latching lock of the coupling device exhibits consistent and repeatable release force characteristics over time despite wear to the device and/or corner casting. Finally, the coupling device of the present invention is provided with a positive stop which resists rolling of stacked containers at onset, but nonetheless utilizes a fully automatic latching lock which allows coupling and decoupling of adjacent cargo containers without manual intervention.

DETAILED DESCRIPTION OF THE INVENTION

Figure 1:
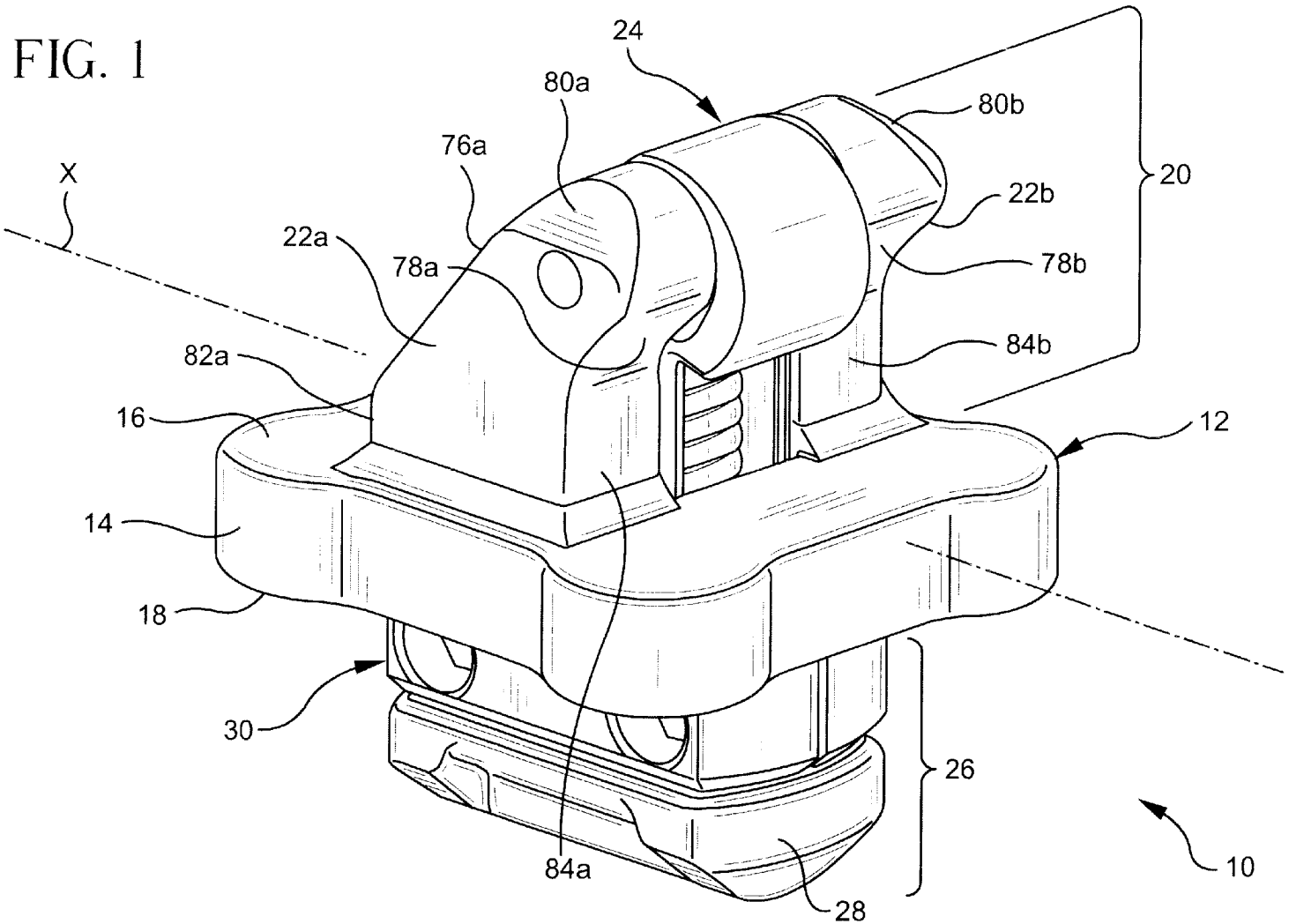
FIG. 1 is a perspective view of the coupling device of the present invention.
Figure 2:
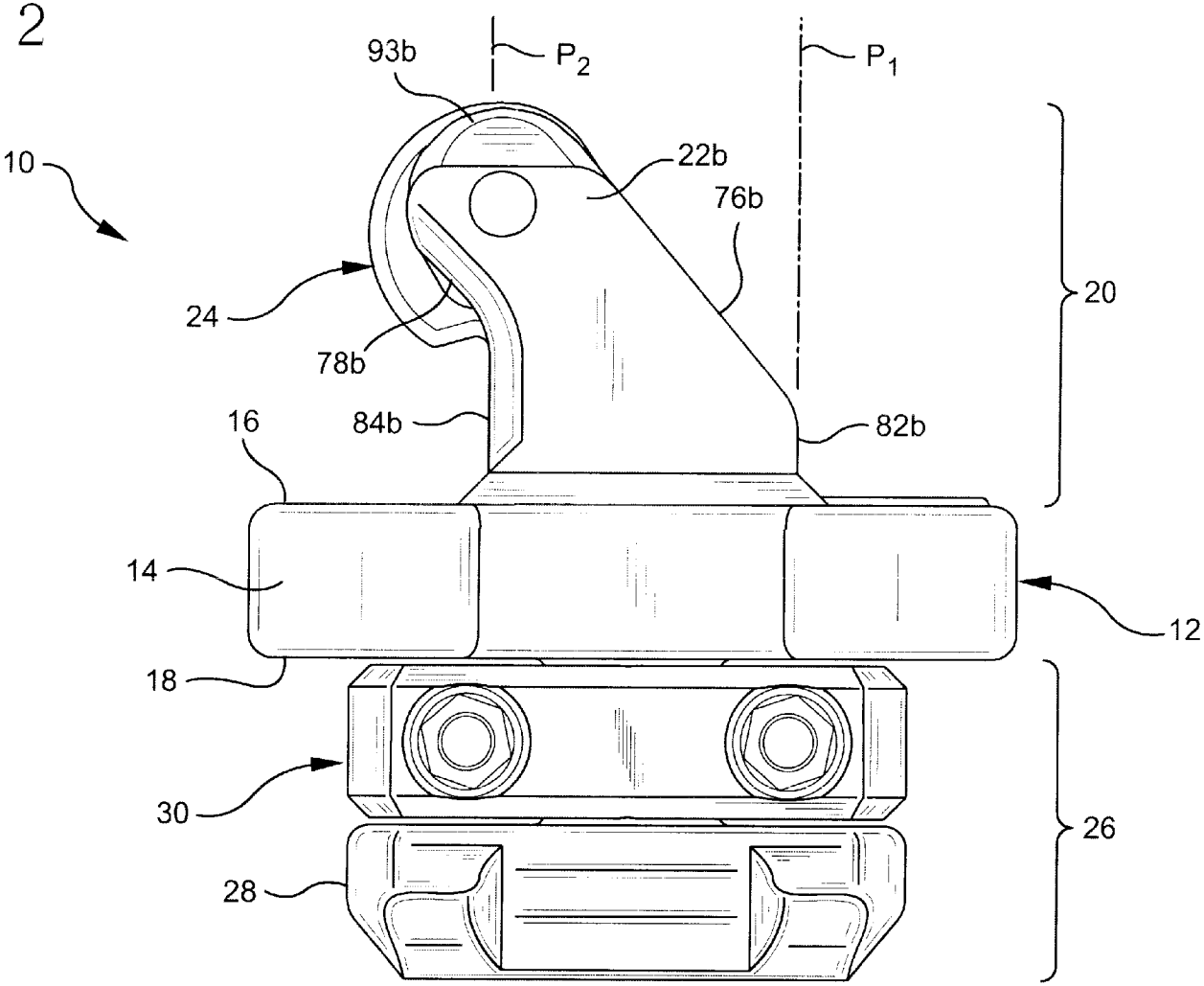
FIG. 2 is a side elevational view of the coupling device of FIG. 1.

Coupling device 10 in accordance with the present invention is shown in FIGS. 1–2. Coupling device 10 includes a body 12 having a base 14. Base 14 includes an upper surface 16 and a lower surface 18.

As will be described more fully hereinbelow, an automatic latching lock 20 is provided on upper surface 16 of base 14. Automatic latching lock 20 allows coupling to and decoupling from a standard corner casting of a freight container without any manual intervention. Automatic latching lock 20 includes a pair of opposing shoulders 22*a*, 22*b* and a latch assembly 24. As shown, shoulders 22*a*, 22*b* are substantial mirror images of one another about a plane extending along axis X and arranged perpendicular to surface 16 of base 14. Shoulders 22*a*, 22*b* together form a landing cone which serves to locate and thereafter guide automatic latching lock 20 into engagement with a corner casting of an adjacent freight container.

Located on the opposite side of base 14 is a manual twisting lock 26 which includes a locking element 28 and a rotatable engagement collar 30. As will be recognized by those skilled in the art, manual twisting lock 26 is secured to a corner casting in a conventional manner, i.e., a cargo handler inserts twisting lock 26 into a corner casting and thereafter manually twists the coupling device to secure locking element 28 within the corner casting. The orientation of locking element 28 in its locked position is shown in FIG. 3*a*.

Figure 3:
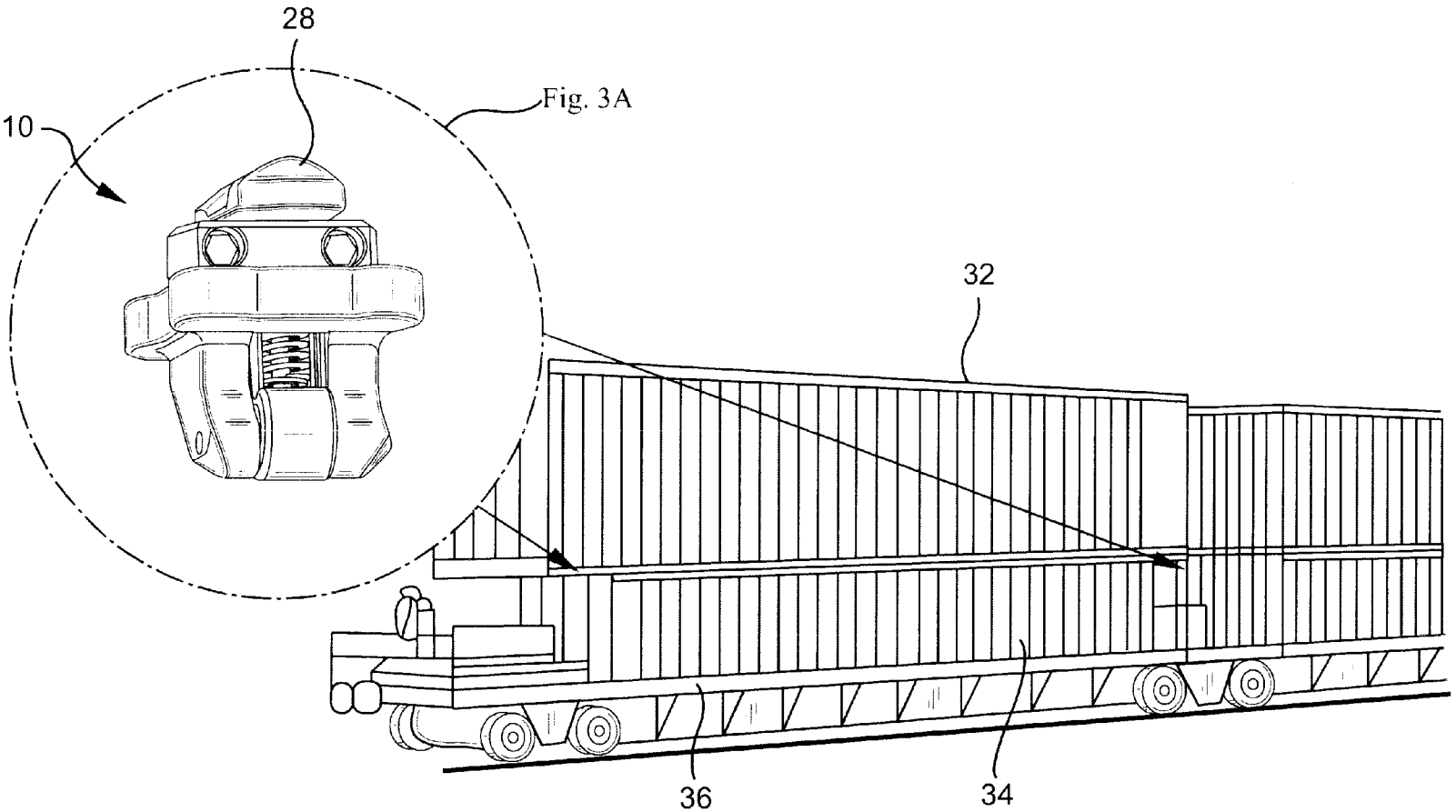
FIG. 3 is a perspective view of a rail car having freight containers stacked thereon.
Figure 3A:
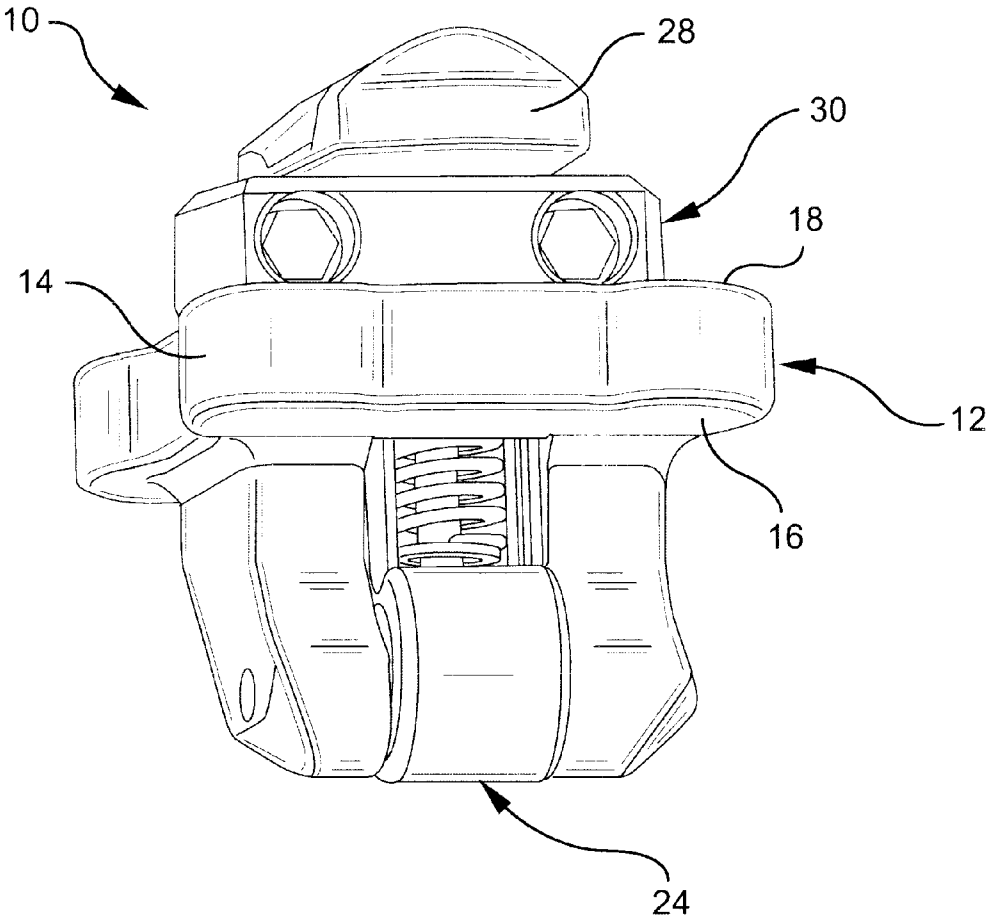
FIG. 3*a* is an enlarged detail depicting the preferred orientation of the coupling device of FIG. 1 when installed between stacked freight containers.
Figure 3B:
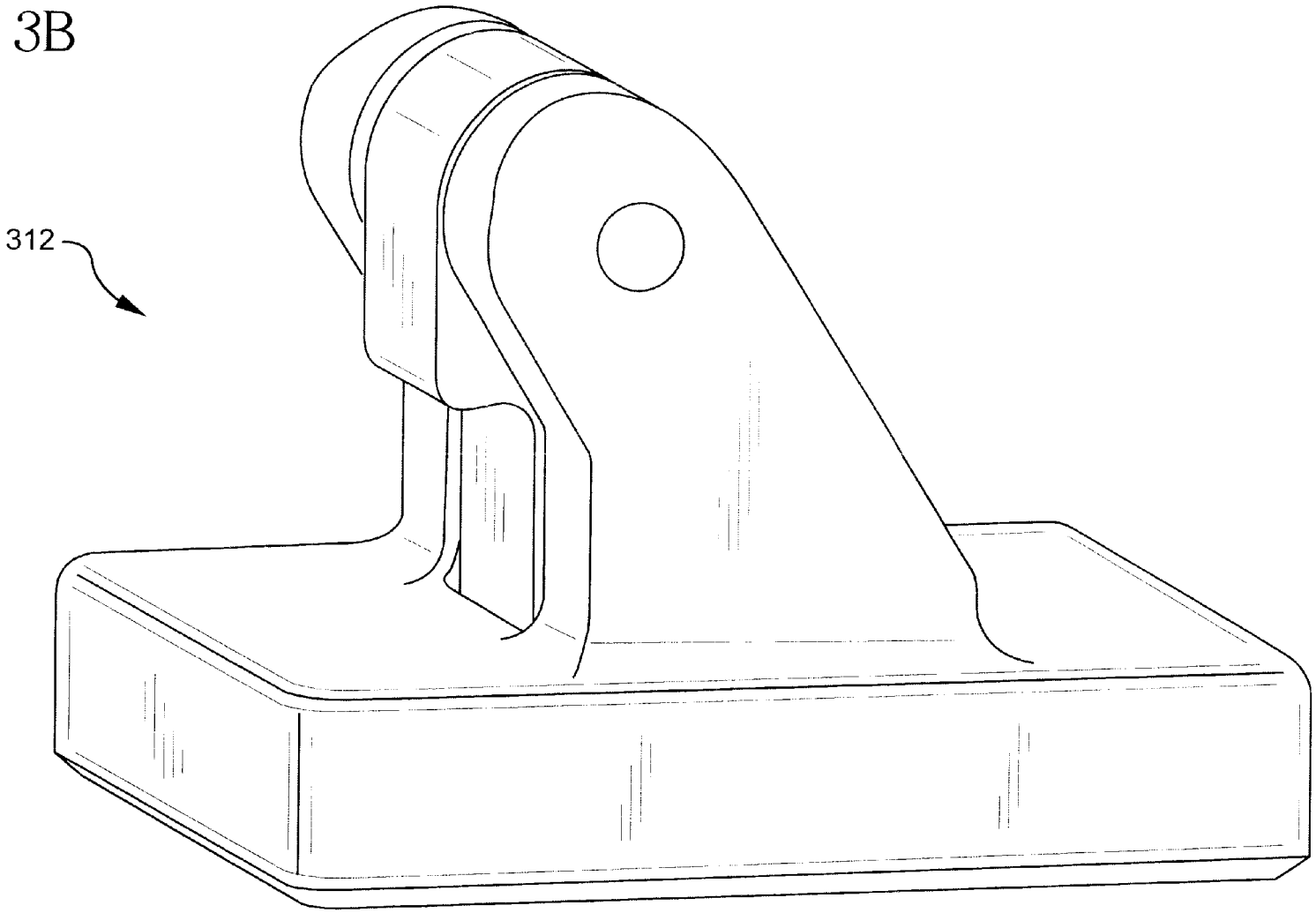
FIG. 3*b* is a perspective view of an alternative coupling device.

Referring now to FIG. 3, coupling device 10 may be utilized to lock an upper freight container 32 to a lower freight container 34. In the arrangement shown in FIG. 3, lower freight container 34 is already secured to the surface of a rail car 36. Alternatively, coupling device 10 may be utilized to secure a freight container directly to the surface of a rail car. In this case, coupling device 10 is secured to the surface of the rail car such that automatic latching lock 20 is upwardly directed. When securing cargo containers directly to the surface of a rail car, coupling device 10 is preferably modified to remove manual twisting lock 26 and thus allow attachment of base 14 directly to the surface of the rail car (see coupling device 312 shown in FIG. 3*b*). Of course, it is contemplated that coupling device 10 can be used in other applications, e.g., securement of stacked container on cargo ships.

As will be appreciated by those skilled in the art, one preferred technique of stacking freight containers involves the attachment of the coupling devices to the underside of upper freight container 32 prior to the landing of upper freight container 32 onto lower freight container 34. Specifically, a cargo handler manually installs four coupling devices on the underside of upper freight container 32 by inserting manual twisting lock 26 into the corner casting located on the underside of upper freight container 32, and thereafter manually twisting the coupling device to secure the coupling device to the corner casting. This process is repeated at each corner of upper freight container 32. The coupling devices are thus secured to the underside of upper freight container 32 in the orientation shown in FIG. 3*a*. Upper freight container 32 is then moved by a crane (not shown) into a position above freight container 34 and then landed thereon. As will be described more fully hereinbelow, automatic latching lock 20 allows both coupling and decoupling of the cargo containers without the need for any manual intervention.

Figure 4:
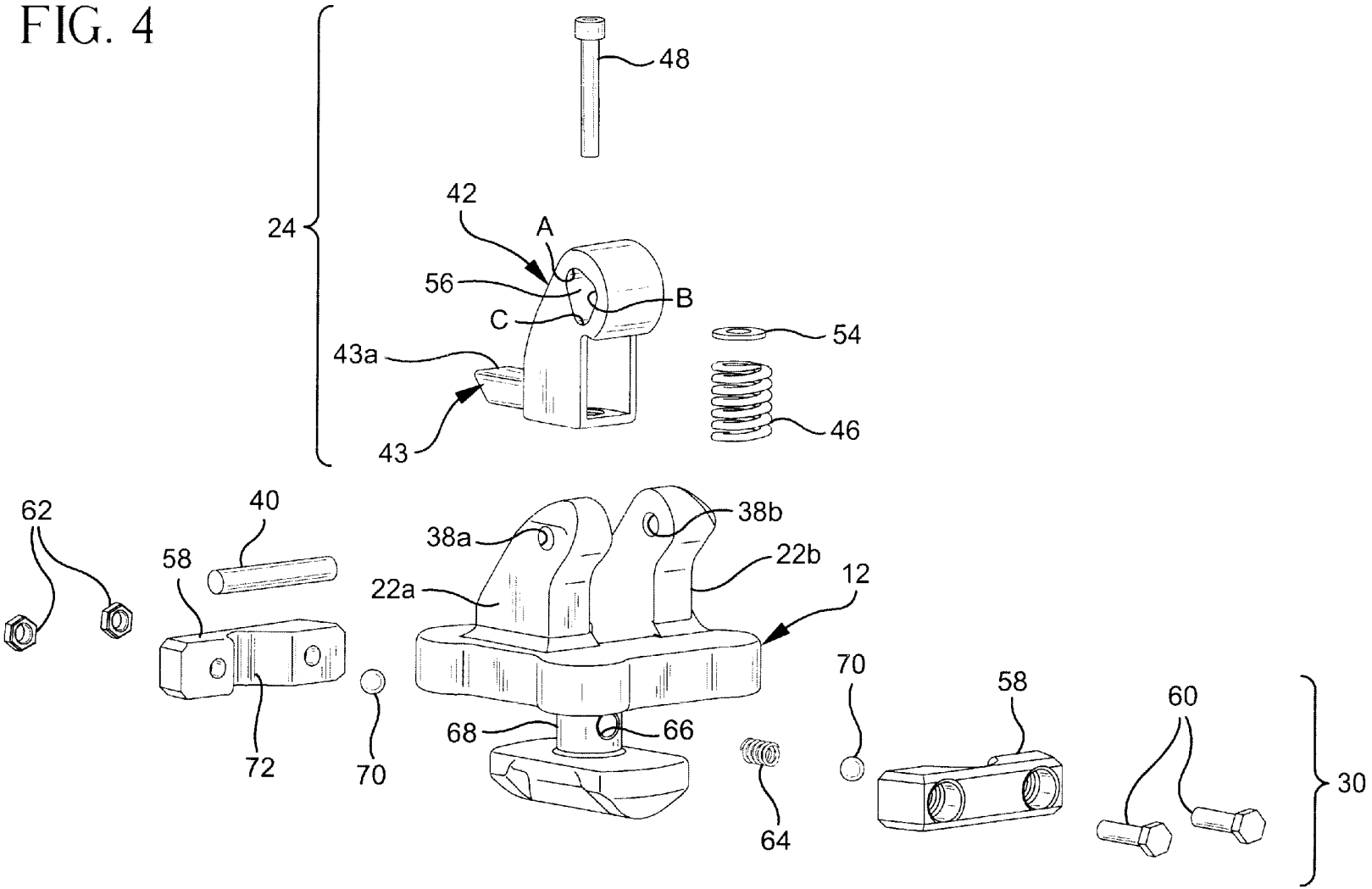
FIG. 4 is an exploded perspective view of the coupling device of FIG. 1.

Referring now to FIG. 4, the components of coupling device 10 are shown in an exploded format. As illustrated, body 12 is preferably formed as a one-piece component by a suitable process such as casting. Each of shoulders 22*a*, 22*b* include an aperture 38*a*, 38*b* for receipt of a pivot pin 40. As shown, latch assembly 24 includes a latch 42 having a cavity 44 for receipt of a compression spring 46. Thus, the lower end of the spring is supported by the latch. A bolt 48 extends through an aperture 50 (see FIG. 5) and engages a threaded aperture 52 (see FIG. 5) formed in base 14, thus maintaining spring 46 within cavity 44. A washer 54 is located at the upper end of the spring and cooperates with the head of bolt 48, thus positionally fixing the upper end of the spring with respect to base 14 (see FIG. 5).

It will be appreciated that bolt 48 allows for tensioning adjustment of spring 46. The force required to move latch 42 and thus release the coupling device from the corner casting may therefore be adjusted. More particularly, by turning bolt 48, the release tension of latch 42 may be adjusted.

Figure 5:
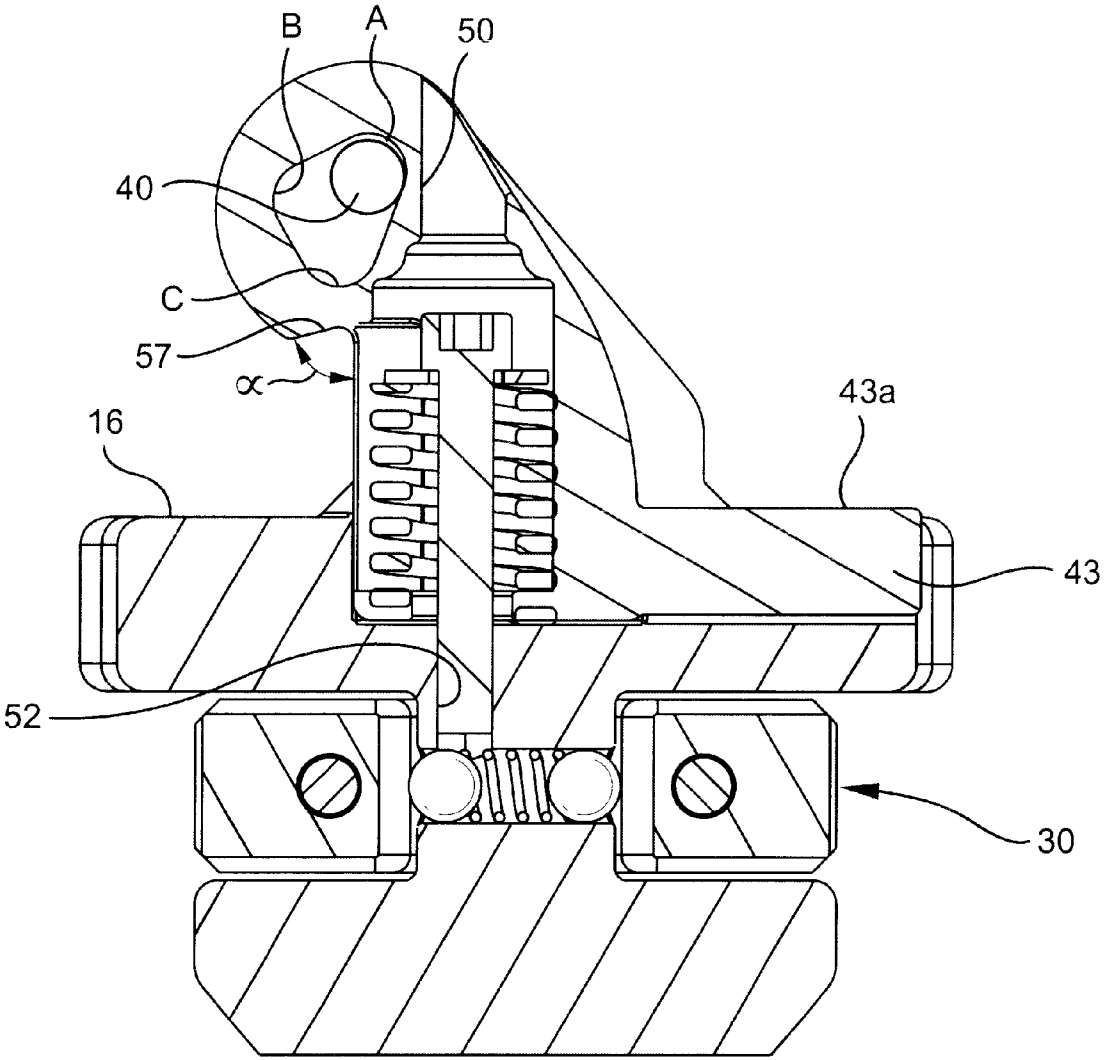
FIG. 5 is a side elevational view, in partial section, of the coupling device of FIG. 1.

Latch 42 includes a triangular aperture 56 extending therethrough and is shown in its "engagement" position in FIG. 5. In the "engagement" position, curved surface A of triangular aperture 56 is pressed against pin 40. Surface A is best seen in FIG. 4. Triangular aperture 56 also includes curved surfaces B and C. Latch 42 also includes a lip 57 which is configured to engage an interior surface of a corner casting when automatic latching lock is coupled thereto. As shown in FIG. 5, lip 57 preferably forms an acute angle $\alpha$ with respect to a surface perpendicular to upper surface 16 when latch 42 is in its engagement position. At the minimum, lip 57 is oriented parallel to upper surface 16 when latch 42 is in its engagement position.

Figure 6:
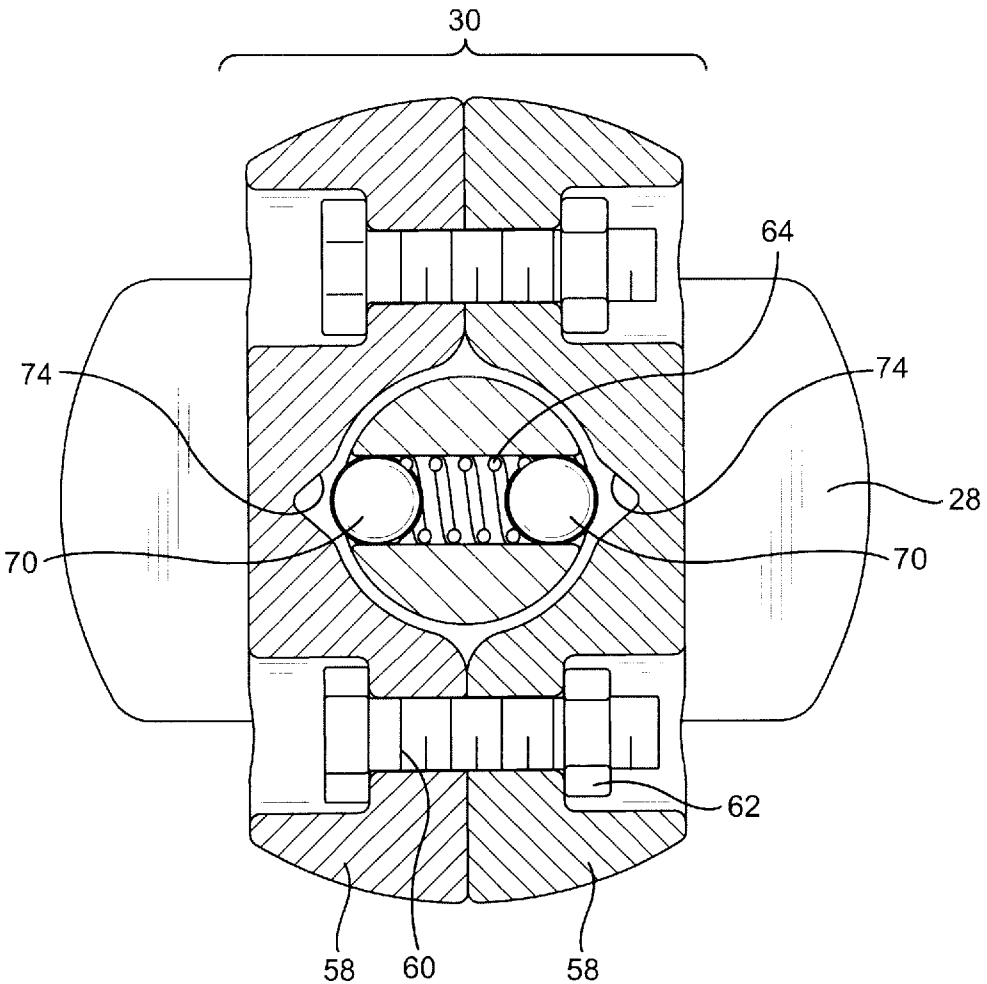
FIG. 6 is a plan view, in partial section, of the coupling device of FIG. 1.

As shown in FIGS. 4–6, rotatable engagement collar 30 includes a pair of opposing collar elements 58 which are secured together via bolts 60 and nuts 62. A spring 64 is inserted within an aperture 66 formed in neck 68 of body 12. A pair of detent balls 70 are also installed within aperture 66, and press against the inside surfaces 72 of collar elements 58. Inside surfaces 72 of collar elements 58 are formed with detents 74 which receive balls 70 and thus rotationally fix collar elements 58, as shown in FIG. 6.

Referring back to FIGS. 1–2, shoulder 22*a* includes a pair of opposing guide surfaces 76*a*, 78*a*, while shoulder 22*b* includes a pair of opposing guide surfaces 76*b*, 78*b*. Each of shoulders 22*a*, 22*b* further includes a chamfered surface 80*a*, 80*b*, respectively, to help position and guide automatic latching lock 20 into a corner casting of a freight container. Shoulder 22*a* also includes corner casting engagement surfaces 82*a*, 84*a*, while shoulder 22*b* includes corner casting engagement surfaces 82*b*, 84*b*. Surfaces 82*a*, 84*a* are substantially parallel to one another and perpendicular to upper surface 16 of base 14. Similarly, engagement surfaces 82*b*, 84*b* are substantially parallel to one another and perpendicular to upper surface 16 of base 14. Surfaces 82*a*, 82*b* define a plane $P_1$, while surface 84*a*, 84*b* define a plane $P_2$.

Figure 7:
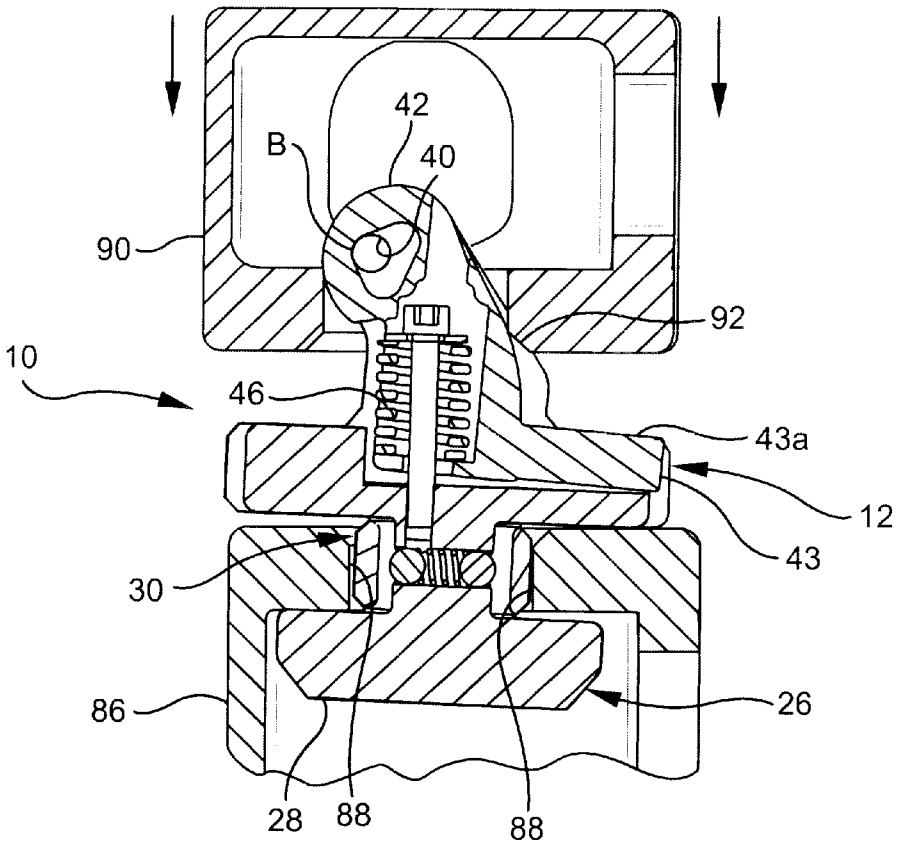
FIG. 7 is a side elevational view, in partial section, of the coupling device of FIG. 1 during coupling with a corner casting.

Referring now to FIG. 7, the manual twisting lock 26 of coupling device 10 is shown secured to corner casting 86. In this regard, rotatable engagement collar 30 is captured between opposing walls 88 of corner casting 86, thus preventing rotation of body 12 with respect thereto. As shown, locking element 28 prevents withdrawal of coupling device 10 from corner casting 86.

FIG. 7 further illustrates the displacement of latch 42 during coupling of device 10 with corner casting 90. More particularly, as corner castings 86 and 90 are moved toward each other, guide surfaces 76*a*, 76*b* contact edge 92 of corner casting 90. As the two corner castings are moved toward each other and as guide surfaces 76*a*, 76*b* slide along edge 92, latch 42 is caused to move to the orientation shown in FIG. 7 (i.e., curved surface B of triangular aperture is pressed against pin 40), which allows the shoulders/latch arrangement to be fully inserted within corner casting 90.

As illustrated, spring 46 undergoes substantially straight compression. This is accomplished through the novel arrangement of spring 46 within cavity 44, and the securement of spring 46 to base 14 via bolt 48 and washer 54. Particularly, cavity 44 is sized to allow the latch to move with respect to the bolt-spring arrangement (e.g., the pivoting of latch 42 depicted in FIG. 7), while maintaining the desired straight compression of spring 46. It will be appreciated that the ability to limit spring 46 to substantially straight compression will provide more accurate predictability regarding the force required to compress the spring, and will provide improved repeatability of release loading. Although spring 46 is depicted as a coil spring, the use of solid (i.e., elastomeric) springs is contemplated herein. The incorporation of cavity 46 within latch 42 allows the use of such solid springs.

Figure 8:
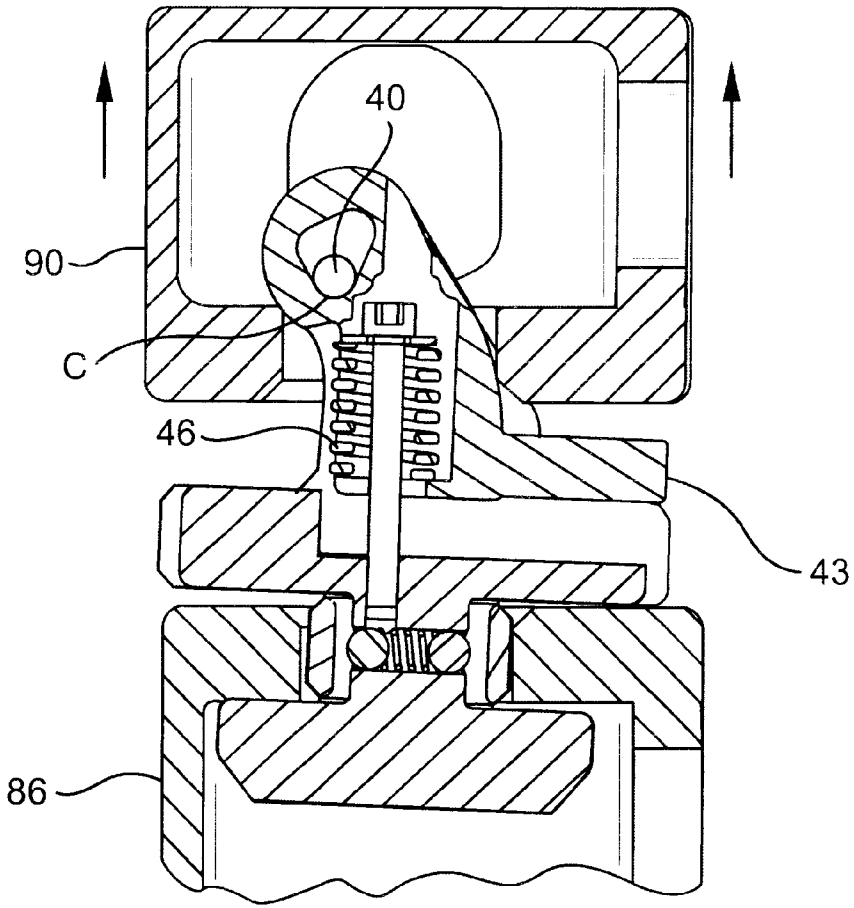
FIG. 8 is side elevational view, in partial section, of the coupling device of FIG. 1 during decoupling from a corner casting.

The displacement of latch 42 during decoupling of corner casting 90 from corner casting 86 is shown in FIG. 8. In this regard, latch 42 is displaced until curved surface C of triangular aperture 52 is pressed against pin 40. Again, spring 46 undergoes substantially straight compression, thus ensuring the predictability and repeatability of the force required to decouple automatic latching lock 20 from corner casting 90. The movement of latch 42 during decoupling of device 10 from corner casting 90 requires additional compression of spring 46. It will be appreciated that this design allows the force required to decouple the device from the corner casting to be greater than the force required to couple the device to the corner casting.

One disadvantage associated with prior art automatic latching locks that will be recognized by those skilled in the art is an inability to positively verify that the latch has returned to its engagement position following landing of a container, thus locking the automatic latching lock to the corner casting of the container. The novel design of the present invention ensures that the latch is returned to its engagement position following landing of a container.

More particularly, latch 42 includes a tail 43 as shown in FIGS. 4–5 and 7–8. When latch 42 is in its engagement position (as shown in FIG. 5), surface 43*a* of tail 43 is located substantially flush with upper surface 16 of base 14. As discussed hereinabove, latch 42 will pivot during coupling of such latch to corner casting 90 (see FIG. 7). It will be appreciated that once corner casting 90 is coupled to device 10, the weight of the container will press against surface 16 thus returning base 14 to a horizontal orientation, and will also press against surface 43*a* of tail 43 thus forcing latch 42 into its engagement position. Of course, it is contemplated herein that the present latch/tail arrangement could be utilized in other automatic latching lock arrangements.

In one alternative embodiment, the location of triangular aperture 56 and apertures 38*a*, 38*b* are reversed, that is, each of apertures 38*a*, 38*b* is replaced with a triangular aperture similar to aperture 56, while triangular aperture 56 is replaced with a circular aperture similar to apertures 38*a*, 38*b* and sized to receive pivot pin 40. Thus, in this embodiment, pin 40 moves with latch 42 as the latch is displaced during coupling and decoupling. The triangular aperture located in the shoulders in this embodiment allow such movement. In another alternative embodiment, the configuration of aperture 56 of latch 42 is modified, e.g., the triangular aperture may be replaced with an L-shaped aperture having a pathway extending between curved surfaces A and B, and continuing between curved surfaces B and C, or may be replaced with any other suitable configuration.

The novel configuration of coupling device 10 allows such device to be arranged in a manner which limits the ability of a container to "lift-off" the underlying structure or container due to a rolling movement. More particularly, coupling device 10 is provided with a positive stop which prevents rolling at onset. The positive stop is defined as the region located on each of the shoulders which intersects and extends beyond plane $P_2$ in a direction extending away from plane $P_1$, e.g., region 93*b* of shoulder 22*b* shown in FIG. 2 (the positive stop includes a similar region located on shoulder 22*a*).

Figure 9:
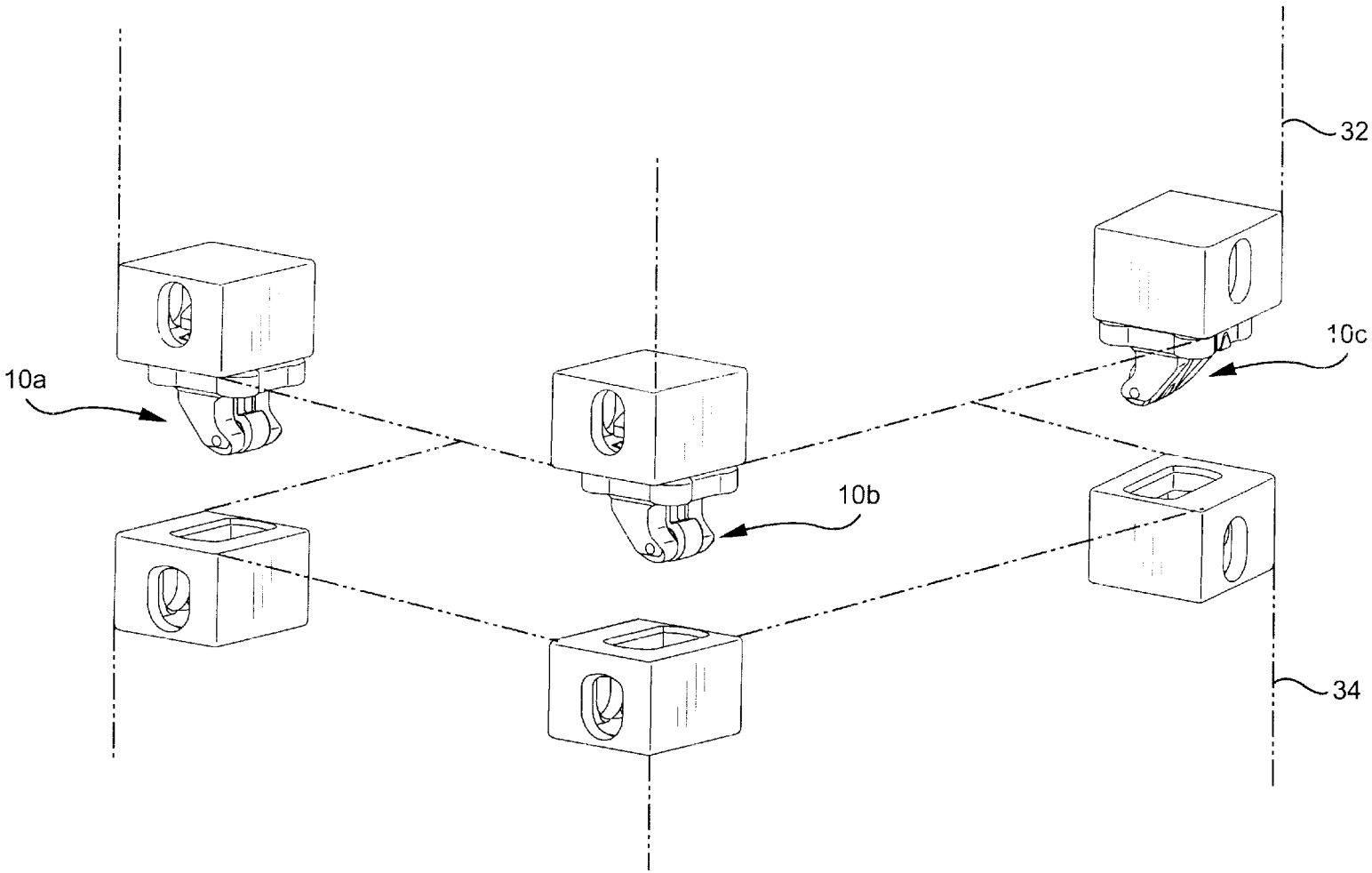
FIG. 9 is a perspective view showing a first freight container positioned under a second freight container.
Figure 10:
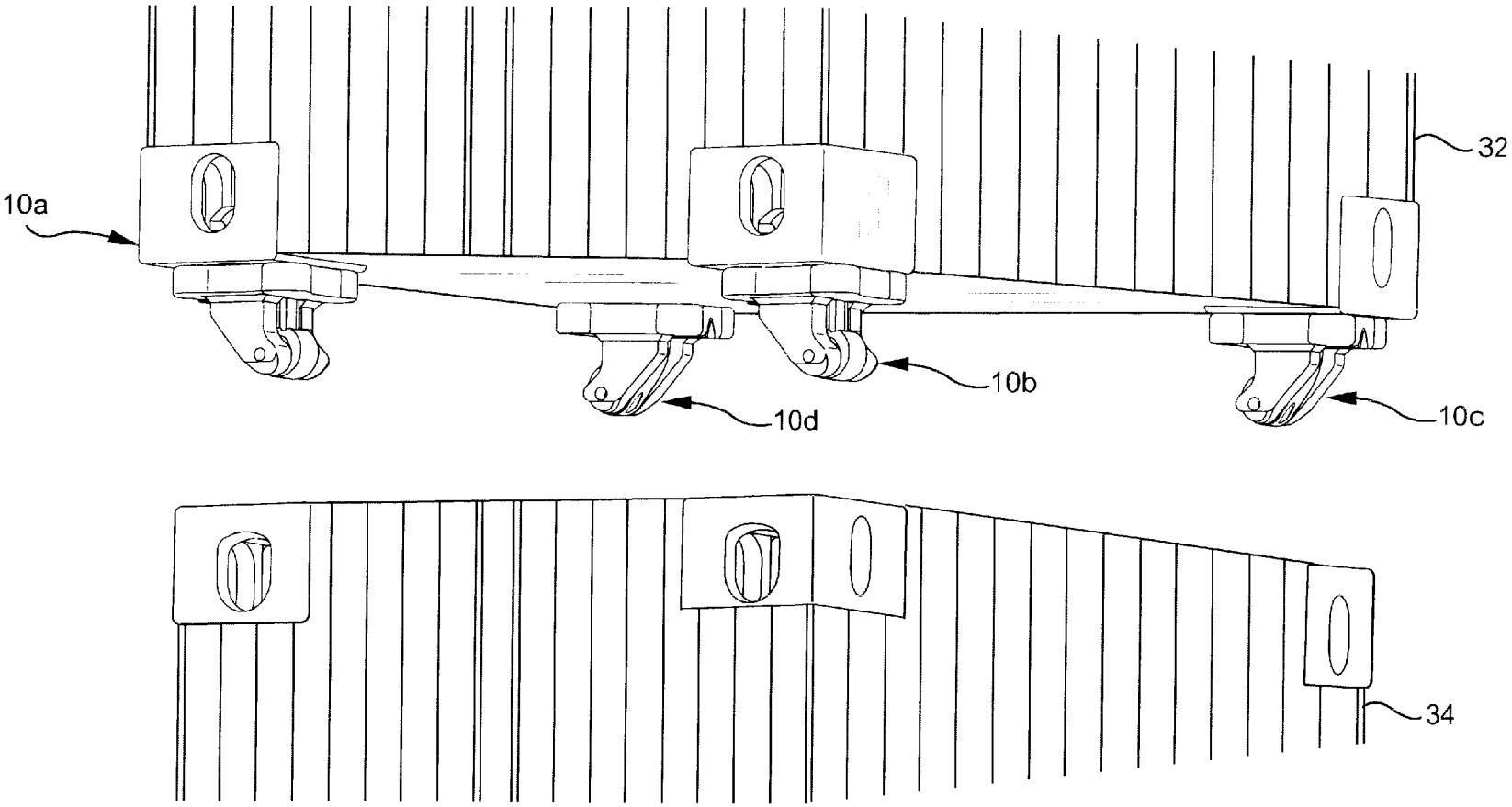
FIG. 10 is another perspective view of the freight containers of FIG. 9.

Referring to FIGS. 9–10, four coupling devices in accordance with the present invention are located and oriented as shown at the four corners of freight container 32. Thus, coupling devices 10*a* and 10*b* are located at the proximate end of cargo container 32 and are oriented in the same direction, while coupling devices 10*c* and 10*d* are located at the distal end and oriented in the same direction as each other, but are rotated 180° with respect to the orientation of coupling devices 10*a* and 10*b*.

Figure 11:
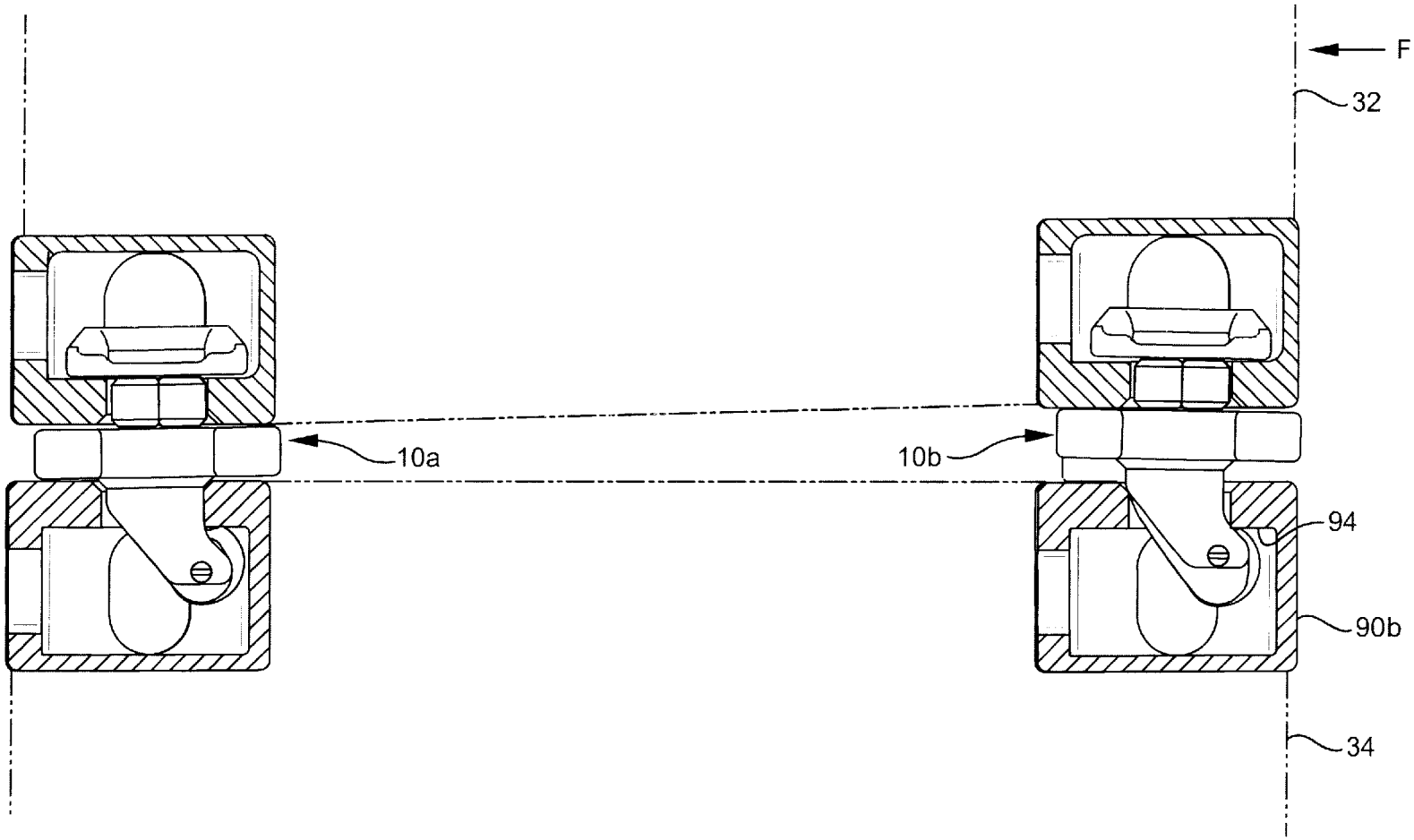
FIG. 11 is side elevational view depicting the freight containers of FIGS. 9–10 in a stacked arrangement during the application of a rolling moment to the upper freight container.

Referring now to FIG. 11, a force F applied to upper cargo container 32 will create a rolling movement which tends to lift the right-hand side of freight container 32 (as viewed in FIG. 11) with respect to the right hand side of lower freight container 34. Although this movement of upper freight container 32 may actuate release latch 42, interior latch-engaging surface 94 of corner casting 90*b* will contact surfaces 78*a*, 78*b* (which form a portion of the mentioned positive stop) of shoulders 22*a*, 22*b* at the onset of rolling, thus limiting any vertical movement of coupling device 10*b* with respect to corner casting 90*b*. Thus, the orientation of coupling devices 10*a* and 10*b* prevents rolling of the cargo container 32 in a counter clockwise direction. Inasmuch as coupling devices 10*c* and 10*d* are oriented 180° from the orientation of coupling devices 10*a* and 10*b*, coupling devices 10*c* and 10*d* will prevent rolling of the container in a clockwise direction.

The arrangement of the devices shown in FIGS. 9–10 thus causes a degree of relative rotation between the adjacent containers during loading and unloading. During loading, the upper cargo container must be rotated slightly to allow all four automatic latching locks to initially engage the openings in the corner castings of the lower cargo container. The coupling of the automatic latching locks to the corner castings causes a translation of coupling devices 10*a* and

10*b* to the right (as oriented in FIG. 10) and a translation of coupling devices 10*c* and 10*d* to the left (as oriented in FIG. 10). Together, this translation causes counter clockwise rotation of upper cargo container 32 during loading (as viewed looking down at upper cargo container 32). This translation and rotation is repeated in reverse during unloading of the upper cargo container.

Figure 12:
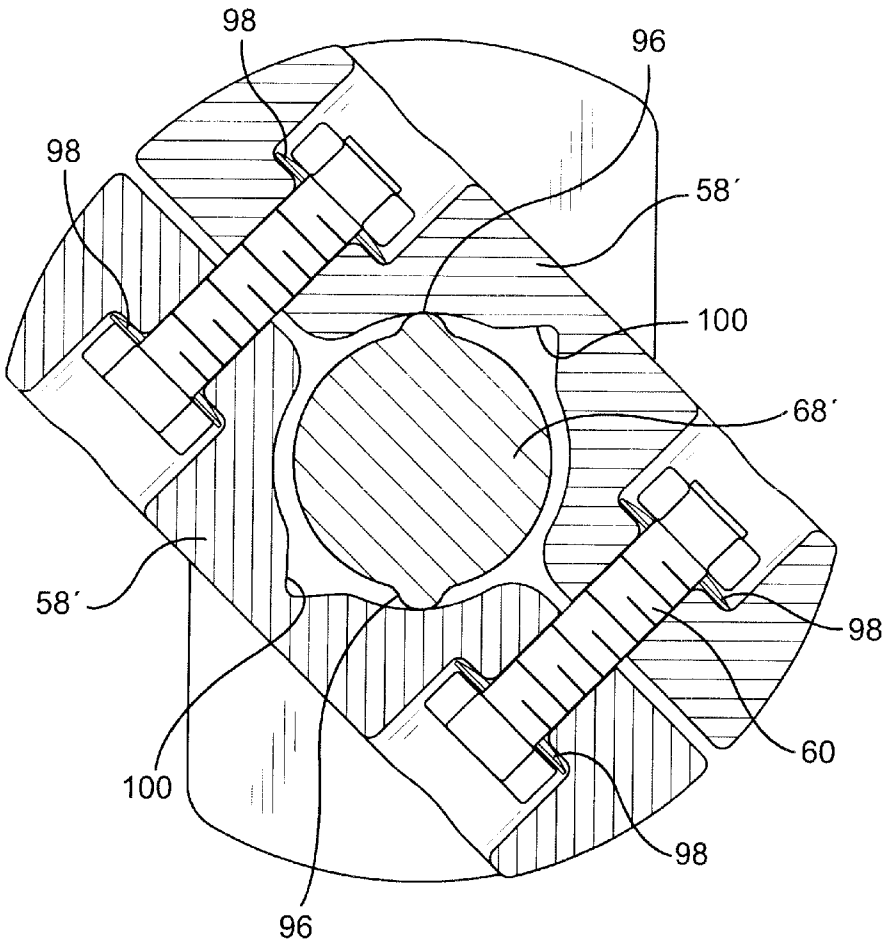
FIG. 12 is a plan view, in partial section, of another alternative coupling device.
Figure 13:
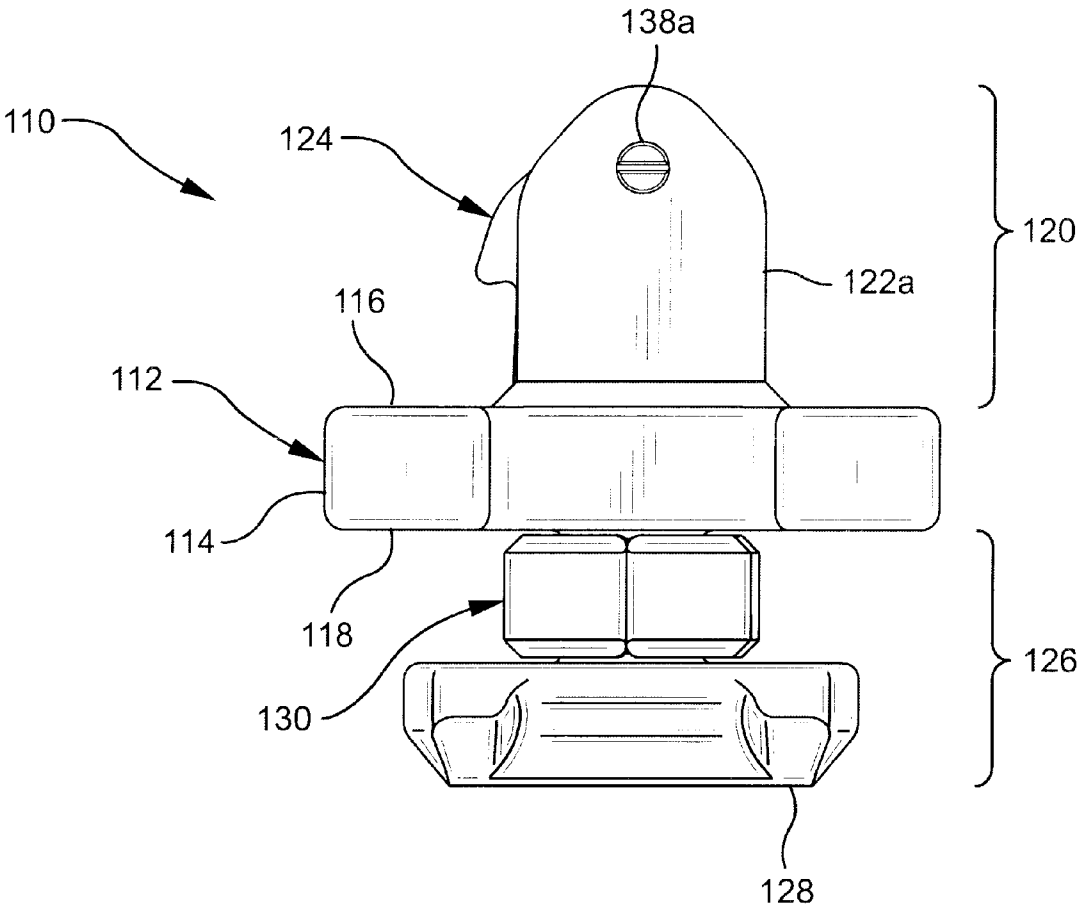
FIG. 13 is an elevational view of still another alternative coupling device.

In one alternative embodiment of the present invention (as shown in FIG. 12), neck 68' of coupling device 10' includes a pair of opposed protrusions 96. A spring washer 98 is located at the head of each bolt 60 and at the bolt/nut interface. Collar elements 58' include detents 100. As engagement collar 30' is rotated about neck 68', protrusions 96 force collar elements 58' apart by compressing spring washers 98. Once engagement collar 30' is rotated 90°, protrusions 96 are positioned within detents 100 thus allowing collar elements 58' to pull together due to the force of spring washers 98. Accordingly,. engagement collar 30' becomes rotatably locked in this orientation. To rotate engagement collar 30' again, a twisting force must be applied thereto sufficient to overcome the force of the spring washers and move protrusions 96 out of detents 100.

An alternative embodiment, i.e., coupling device 110, is shown in FIGS. 13–16. Coupling device 110 includes a body 112 having a base 114. Base 114 includes an upper surface 116 and a lower surface 118. Automatic latching lock 120 includes a pair of opposing support shoulders 122*a*, 122*b* and a latch assembly 124. Shoulders 122*a*, 122*b* are substantial mirror images of one another. Shoulders 122*a*, 122*b* together form a landing cone which serves to locate and thereafter guide the automatic latching lock into engagement with a corner casting of an adjacent freight container. Coupling device 110 further includes a manual twisting lock 126, which in turn includes locking element 128 and a rotatable engagement collar 130. Manual twisting lock 126 functions in the same manner as described hereinabove with respect to manual twisting lock 26.

Body 112 is preferably formed as a one piece component by a suitable process such as casting. Each of shoulders 122*a*, 122*b* include an aperture 138*a*, 138*b* for receipt of a pivot pin 140. Latch assembly 124 is similar to latch assembly 24, and includes a latch 142 having a cavity 144 for receipt of a compression spring 146. A bolt 148 extends through an aperture 150 and engages a threaded aperture 152 formed in base 114, thus maintaining spring 146 within cavity 144. A washer 154 is located at the upper portion of the spring and cooperates with the head of bolt 148 to allow tensioning adjustment of spring 146.; Finally, latch 142 includes a triangular aperture 156 extending therethrough.

Figure 14:
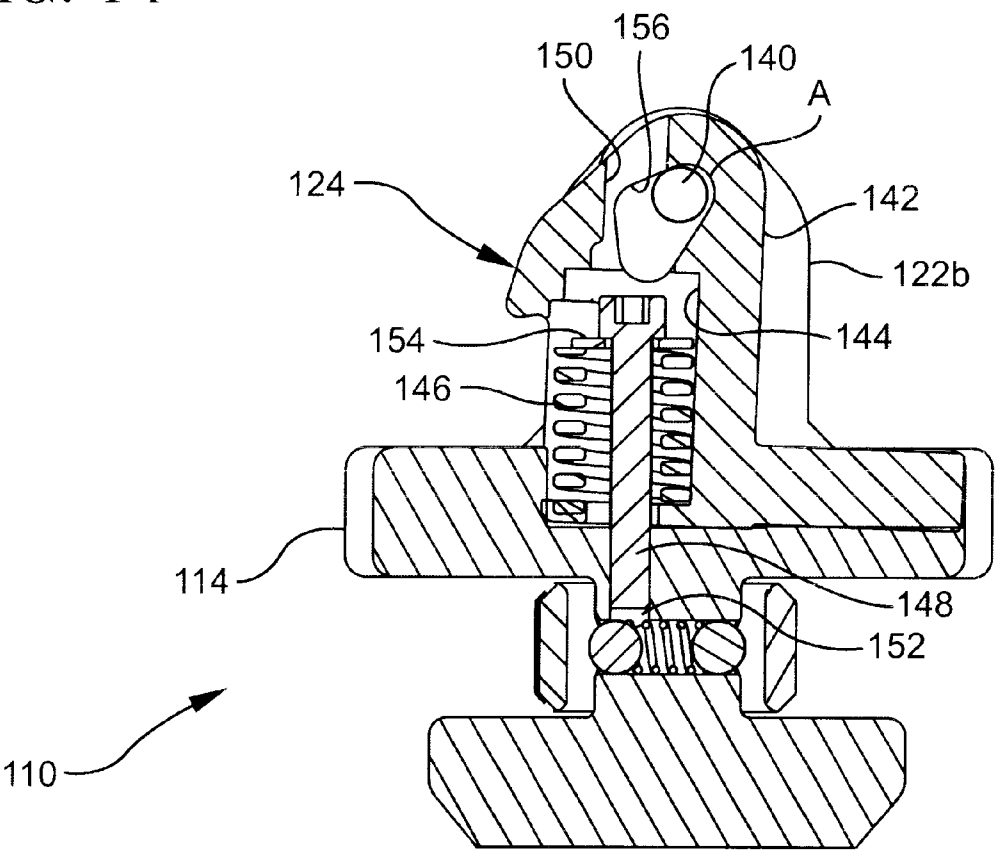
FIG. 14 is a side elevational view, in partial section, of the coupling device of FIG. 13.

Latch 142 is shown in its "engagement" position in FIG. 14. In the "engagement" position, curved surface A of triangular aperture 156 is pressed against pin 140. Triangular aperture 156 also includes curved surfaces B and C.

Figure 15:
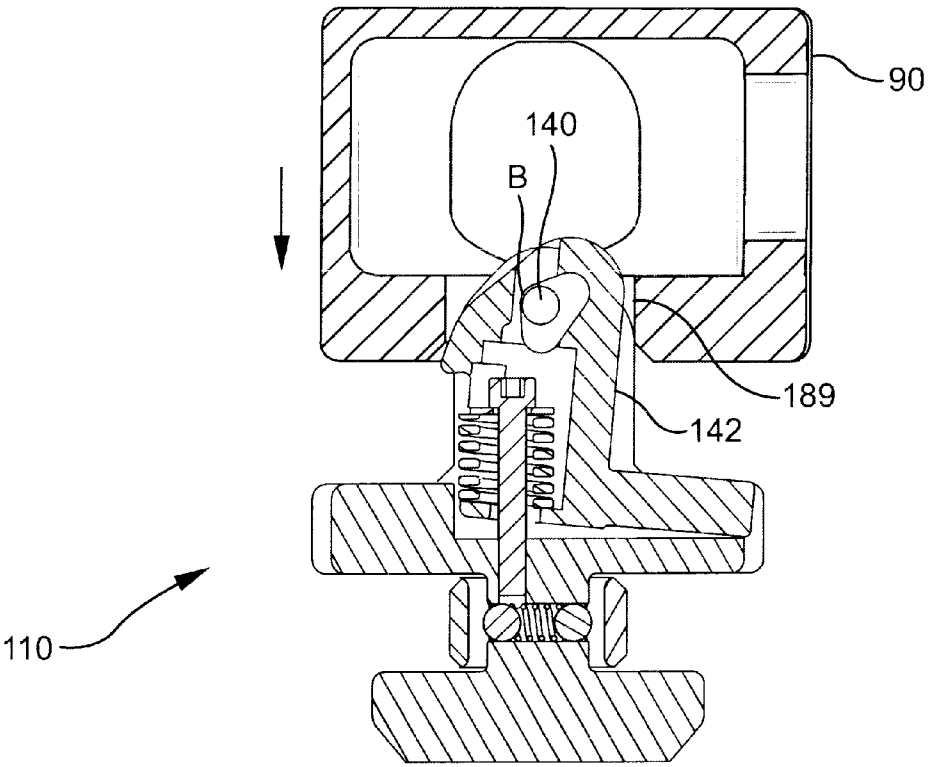
FIG. 15 is side elevational view, in partial section, of the coupling device of FIG. 13 during coupling with a corner casting.

Referring now to FIG. 15, coupling device 110 is shown being coupled to corner casting 90 of a cargo container (not shown). As support shoulders 122*a*, 122*b* penetrate rectangular opening 189 of corner casting 90, latch 142 is translated to the position shown in FIG. 15. More particularly, latch 142 is translated until curved surface B of triangular aperture 156 is pressed against pin 140. This movement of latch 142 causes compression of spring 146. Again, the design of cavity 144 allows relative movement between the latch and the bolt/spring arrangement, thus ensuring that the compression of spring 146 is substantially straight.

Figure 16:
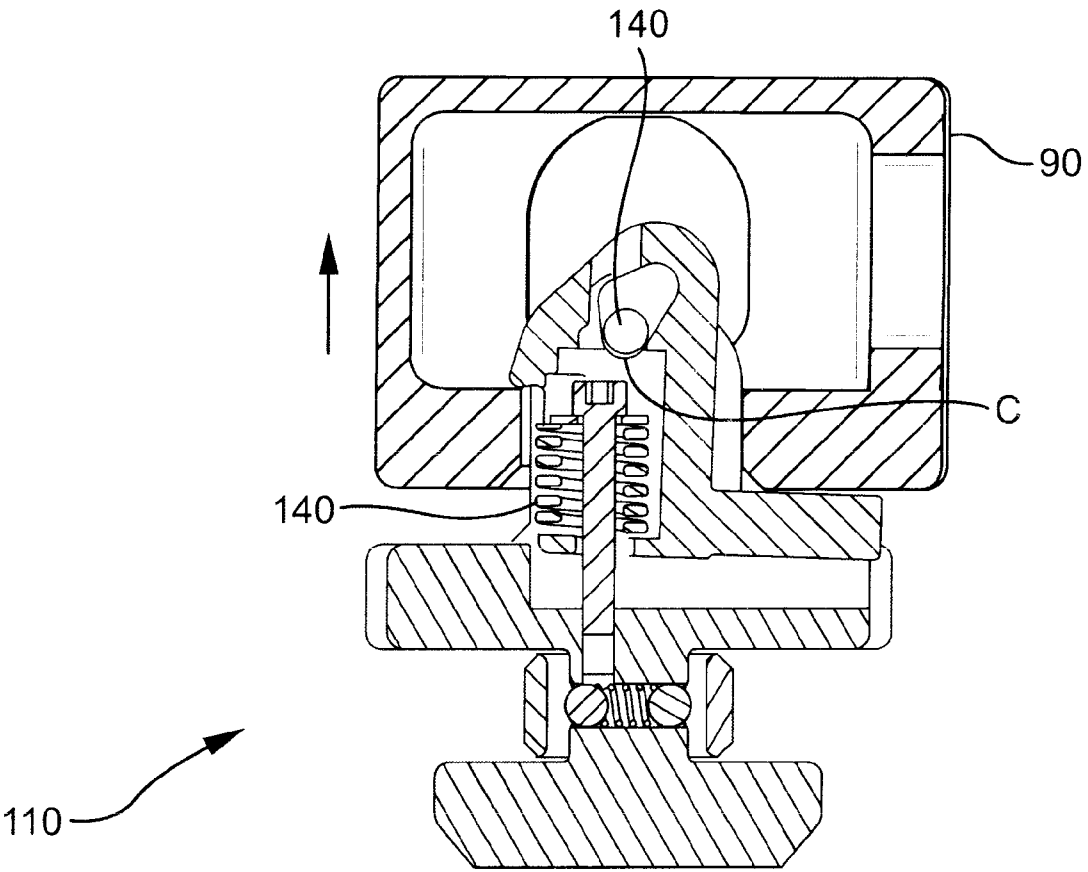
FIG. 16 is a side elevational view, in partial section, of the coupling device of FIG. 13 during decoupling from a corner casting.

Referring now to FIG. 16, coupling device 110 is shown being removed from corner casting 90. During this removal, latch 142 is translated to the position shown in FIG. 16. More particularly, latch 142 is translated until curved surface C of triangular aperture 156 is pressed against pin 140. The movement of latch 142 during removal of coupling device 110 from corner casting 90 requires additional compression of spring 146. It will be appreciated that this design allows the force required to decouple the device from the corner casting to be greater than the force required to couple the device to the corner casting. Moreover, the design of the automatic latching lock, which ensures that spring 146 undergoes substantially straight compression, provides the coupling device with repeatability of its release force characteristics.

Figure 17:
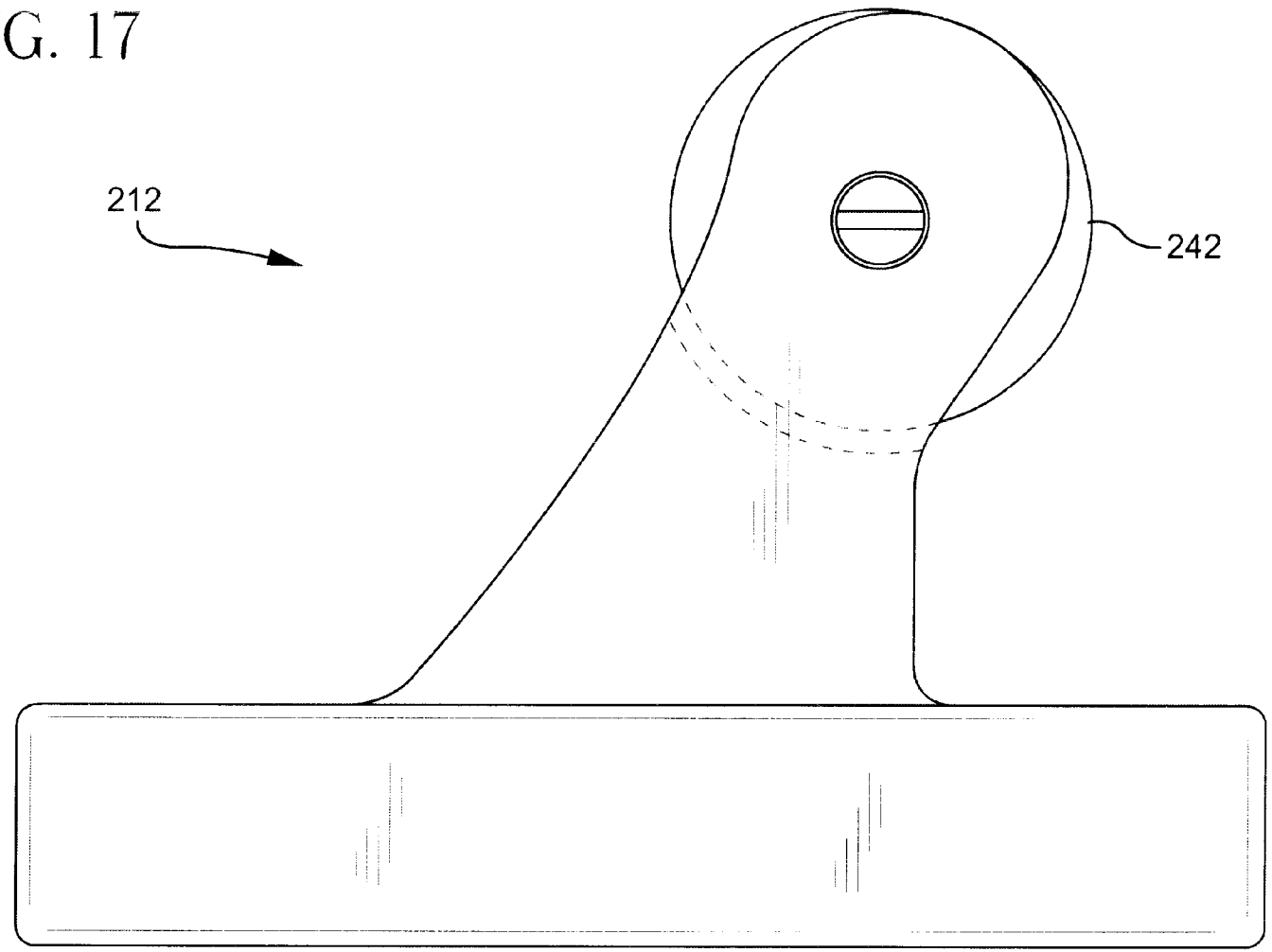
FIG. 17 is a side elevational view of a further alternative coupling device.

In another embodiment of the present invention, as shown in FIG. 17, the latch of coupling device 212 is replaced by a wheel 242. Wheel 242 facilitates coupling and decoupling of the latching lock due to the rotation of the wheel when contacting the corner casting.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendment and/or deviations be included within the scope of the following claims.

What is claimed is:

1. A coupling device for cooperation with a corner casting of a freight container, said corner casting including an interior latch-engaging surface, comprising:

a body including a base having first and second surfaces; and an automatic latching lock extending from said first surface of said base and being sized and located for securement to said corner casting of said freight container, said automatic latching lock including a first support shoulder and a latch assembly, said latch assembly being movably coupled to said support shoulder to allow coupling to and decoupling from said corner casting and being biased to an engagement position, said latch assembly including a latch having a spring-receiving cavity; and a spring positioned within said cavity and having first and second ends, said first end being supported by said latch, and said second end being surrounded by said cavity and positionally fixed with respect to said base.

2. The device according to claim 1, wherein said body further includes a second support shoulder, and wherein said latch assembly is movably supported between said first and second support shoulders; and further comprising a pin extending between said support shoulders for coupling said latch assembly thereto.

3. The device according to claim 2, wherein each of said support shoulders includes first and second corner casting engagement surfaces oriented substantially perpendicular to said base, said first corner casting engagement surfaces defining a plane $P_1$ and said second corner casting engagement surfaces defining a plane $P_2$, and wherein at least a portion of each of said support shoulders intersects and extends beyond plane $P_2$ in a direction extending away from plane $P_1$ thus defining a container roll-limiting positive stop.

4. The device according to claim 3, wherein each of said support shoulders includes guide surfaces angled with respect to upper surface of said base for guiding said automatic latching lock into engagement with said corner casting.

5. The device according to claim 2, wherein said latch includes a triangular aperture, and wherein said pin extends through said triangular aperture.

6. The device according to claim 5, wherein said triangular aperture defines a first direction of movement of said latch during coupling of said automatic latching lock to said corner casting and a second direction of movement of said latch during decoupling of said automatic latching lock from said corner casting.

7. The device according to claim 6, wherein said latch includes a bolt pass-through aperture and wherein said base includes a threaded aperture, and wherein said bolt pass-through aperture and said threaded aperture are substantially co-axially aligned when said latch is in said engagement position, and further comprising a bolt sized to engage said threaded aperture, said bolt cooperating with said spring to retain said spring within said cavity and passing through said bolt pass-through aperture to engage said threaded aperture.

8. The device according to claim 7, wherein said latch further includes an access aperture substantially co-axially aligned with said bolt pass-through aperture to allow ready access to and adjustment of said bolt.

9. The device according to claim 8, wherein said bolt includes a head; and further comprising a washer sized to cooperate with said head of said bolt and to engage said second end of said spring.

10. The device according to claim 1, wherein said first support shoulder extends from said first surface; and further comprising a manual twisting lock extending from said second surface.

11. The device according to claim 10, wherein said manual twisting lock includes a neck extending from and connected at one end to said second surface of said base, said manual twisting lock further including a locking element connected to the other end of said neck, said neck including a pair of opposing protrusions, said manual twisting lock further including a pair of opposing collar elements each having an interior wall surface, said collar elements surrounding said neck and arranged as to allow relative expansion therebetween via interaction between said protrusions and said interior wall surfaces of said collar elements, said interior wall surfaces of said collar elements further including at least one pair of opposing detents sized to receive said protrusions for releasably fixing said collar element at a predetermined rotational orientation.

12. The device according to claim 1, wherein said latch includes a lip for engaging said interior latch-engaging surface of said corner casting, said lip extending towards said first surface of said body when said latch is in said corner casting engaging position.

13. The device according to claim 1, wherein said latch includes a tail, said tail having an upper contact surface located substantially flush with said first surface of said base when said latch is in said engagement position whereby said corner casting presses against both said first surface of said base and said contact surface of said tail when said automatic latching lock is coupled to said corner casting thus urging said latch to said engagement position.

14. A coupling device for cooperation with a corner casting of a freight container, comprising:

a body including a base having first and second surfaces; and an automatic latching lock extending from said first surface of said base and being sized and located for securement to said corner casting of said freight container; said automatic latching lock including a first support shoulder and a latch assembly, said latch assembly being movably coupled to said support shoulder to allow coupling to and decoupling from said corner casting and being biased to an engagement position, said latch assembly being movable in a first direction from said engagement position to a first coupling position to allow coupling of said automatic latching lock to said corner casting and being movable in a second direction from said engagement position to a second decoupling position to allow decoupling of said automatic latching latch lock from said corner casting, said first direction being different from said second direction, and said first coupling position being different from said second decoupling position.

15. The device according to claim 14, wherein said second direction is substantially perpendicular to said first surface.

16. The device according to claim 15, further comprising a spring for biasing said latch assembly to said engagement position, and wherein said latch assembly includes a latch having a cavity sized to receive said spring and restrict said spring to substantially straight compression during coupling to and decoupling from said corner casting.

17. The device according to claim 14, wherein said latch assembly is free-floating with respect to said body.

18. A coupling device for cooperation with a corner casting of a freight container, comprising:

a body including a base having first and second surfaces; and an automatic latching lock extending from said first surface of said base and being sized and located for securement to said corner casting of said freight container, said automatic latching lock including a latch assembly, said latch assembly being movably coupled to said base to allow coupling to and decoupling from said corner casting and being biased to an engagement position, said latch assembly including a latch having a tail, said tail including an upper contact surface located substantially flush with said first surface of said base when said latch is in said engagement position whereby said corner casting presses against both said first surface of said base and said contact surface of said tail when said automatic latching lock is coupled to said corner casting thus urging said latch to said engagement position.

19. A coupling device for coupling a corner casting of a first freight container to a corner casting of a second freight container, comprising:

a body including a base, said base having a first surface and a second surface;

an automatic latching lock for coupling with said corner casting of said first freight container, said automatic latching lock being provided on said first surface of said base;

a manual twisting lock for coupling with said corner casting of said second freight container, said manual twisting lock being provided on said second surface of said base, said manual twisting lock including a neck extending from and connected at one end to said second surface of said base, said manual twisting lock further including a locking element connected to the other end of said neck, said neck including a pair of opposing protrusions, said manual twisting lock further including a pair of opposing collar elements each having an interior wall surface, said collar elements surrounding said neck and arranged as to allow relative expansion therebetween via interaction between said protrusions and said interior wall surfaces of said collar elements, said interior wall surfaces of said collar elements further including at least one pair of opposing detents sized to receive said protrusions for releasably fixing said collar element at a predetermined rotational orientation.

20. The container lock according to claim 19, further comprising first and second hardware sets for securing said collar elements about said neck, and further comprising at least one spring washer cooperating with each of said sets to allow relative expansion of said collar elements during rotation of said collar elements about said neck.

21. A coupling device for cooperation with a corner casting of a freight container, said corner casting including an interior latch-engaging surface, comprising:

a body including a base having first and second surfaces; and an automatic latching lock extending from said first surface of said base and being sized and located for securement to said corner casting of said freight container, said automatic latching lock including a first support shoulder and a latch assembly, said latch assembly being movably coupled to said support shoulder to allow coupling to and decoupling from said corner casting, and wherein said latch assembly includes a wheel rotatable with respect to said first support shoulder and located to engage said corner casting.

22. A method of stacking a first freight container onto a second freight container, comprising:

providing a first rectangular freight container having a length and a width and an upper surface, said first freight container having first, second, third and fourth corner castings located along said upper surface, said first and second corner castings positioned at one end of said freight container along said width, said third and fourth corner castings positioned at the other end of said freight container along said width;

providing a second rectangular freight container having a length and a width and a lower surface, said second freight container having first, second, third and fourth corner castings located along said lower surface, said first and second corner castings positioned at one end of said freight container along said width, said third and fourth corner castings positioned at the other end of said freight container along said width;

providing first, second, third and fourth coupling devices, each of said coupling devices comprising:

a body having a base with first and second surfaces;

an automatic latching lock associated with said first surface, said automatic latching lock including a landing cone having a positive stop, said landing cone defining a roll-limiting direction, a manual twisting lock associated with said second surface;

securing said manual twisting locks of said first and second coupling devices to said first and second corner castings of said second container such that each of said landing cones is oriented in a first direction;

securing said manual twisting locks of said third and fourth coupling devices to said third and fourth corner castings of said second container such that each of said landing cones is oriented in a second direction, said first and second directions being oriented 180° apart from one another; and landing said second freight container on said first freight container such that said automatic latching locks of said first, second, third, and fourth coupling devices engage said first, second, third and fourth corner castings of said first freight container, respectively, whereby said first and second coupling devices limit rolling of said second freight container in a first direction and said third and fourth coupling devices limit rolling of said second freight container in a second direction.

* * * * *